US007674146B2

(12) United States Patent
Iwashita

(10) Patent No.: US 7,674,146 B2
(45) Date of Patent: Mar. 9, 2010

(54) PROPELLER THRUST TRANSMISSION DEVICE FOR A WATERCRAFT PROPULSION DEVICE

(75) Inventor: Takashi Iwashita, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 14 days.

(21) Appl. No.: 11/956,493

(22) Filed: Dec. 14, 2007

(65) Prior Publication Data

US 2008/0146097 A1 Jun. 19, 2008

(30) Foreign Application Priority Data

Dec. 14, 2006 (JP) ..... 2006-337522

(51) Int. Cl.

| | |
|---|---|
| ***B63H 5/07*** | (2006.01) |
| *B63H 1/14* | (2006.01) |
| *B63H 1/15* | (2006.01) |
| *B63H 21/30* | (2006.01) |
| *B63H 23/34* | (2006.01) |

(52) U.S. Cl. ..... 440/79; 440/49; 440/52; 440/83

(58) Field of Classification Search ..... 440/75, 440/49, 53, 78, 79, 81, 83
See application file for complete search history.

(56) References Cited

U.S. PATENT DOCUMENTS 4,317,655 A * 3/1982 Schiek ..... 440/78
4,436,514 A * 3/1984 Takahashi et al. ..... 440/89 R

* cited by examiner

*Primary Examiner*—Daniel V Venne
(74) *Attorney, Agent, or Firm*—Keating & Bennett, LLP

(57) ABSTRACT

A propeller thrust transmission device includes a taper portion of a propeller shaft that is fitted in a spacer divided into a first half and a second half. A thrust force acting on a propeller is received by the taper portion of the propeller shaft through the spacer. The first half includes a taper hole having an inner surface which corresponds in shape to an outer surface of the taper portion and in which the taper portion is fitted. The second half has a smaller diameter portion extending from one side of a ring-shaped wall portion closer to the propeller and fitted in a hole of an attachment device spaced from the propeller shaft, and a larger diameter portion extending from the other side of the ring-shaped wall portion and fitted on an outer peripheral surface of the first half.

5 Claims, 4 Drawing Sheets

PROPELLER THRUST TRANSMISSION DEVICE FOR A WATERCRAFT PROPULSION DEVICE

BACKGROUND OF THE INVENTION

1. Field of the Invention

The present invention relates to a propeller thrust transmission device for a watercraft propulsion device, which is a device arranged to transmit a thrust force acting on a propeller to a propeller shaft as the propeller in an outboard motor or an inboard/outboard motor rotates.

2. Description of the Related Art

Conventionally, a propeller thrust transmission device, which is a device arranged to transmit a thrust force acting on a propeller to a propeller shaft as the propeller in a watercraft propulsion device rotates, includes a taper portion and a spacer on the propeller shaft. One conventional propeller thrust transmission device of an exhaust device for an outboard motor and the like is disclosed in FIG. 2 of JP-B-Sho 62-15399.

FIG. 4 of the present application is an enlarged cross-sectional view showing a propeller thrust transmission device for a watercraft propulsion device that is practically equivalent to the propeller thrust transmission device shown in FIG. 2 of JP-B-Sho 62-15399. The propeller thrust transmission device has the following structure. An attachment device 14 of a propeller 13 is fitted in and fixed to an outer shaft portion 11*a* protruding outward from a gear case 12. The propeller thrust transmission device includes a taper portion 11*b* near the gear case such that a diameter of an end closer to the gear case is larger than a diameter of an end closer to the propeller, and a spacer 16 in which the taper portion 11*b* is fitted. This attachment device 14 includes a boss 14*a* united with a blade portion of the propeller and having an exhaust passage for passing combustion gas of an engine therethrough, a tube-shaped rubber damper 14*b* press-fitted in the boss 14*a*, a bushing 14*c* press-fitted inside a rubber damper 14*b*, and an end plate 14*d*. The attachment device 14 is fixed by a nut 15. The spacer 16 is shaped to have a taper hole 16*a* having an inner surface which corresponds in shape to an outer surface of the taper portion 11*b* (i.e., the inner surface of the taper hole 16*a* has a complementary shape to the outer surface of the taper portion 11*b*) and in which the taper portion 11*b* is fitted, an end surface 16*b* touching an end wall 14*a*' of the boss 14*a*, and a smaller diameter tube portion 16*c* (i.e., having a smaller diameter than an outer diameter of the other portions of the spacer 16) fitted in a hole 14*a*" in the end wall 14*a*'. In this propeller thrust transmission device, the taper portion 11*b* of the propeller shaft 11 receives a thrust force acting on the propeller 13 through the spacer 16 as the propeller 13 rotates in a normal direction.

However, in the propeller thrust transmission device for a watercraft propulsion device shown in FIG. 4, when a watercraft is propelled at a high speed (when the propeller rotates at high speed), a hull or a stern comes to the surface, a draft line lowers, an upper portion of the propeller is exposed to air, and a water resistance force F acts upward on a lower portion of the propeller 13. In such a situation, this water resistance force F is transmitted from the attachment device 14 of the propeller 13 to the smaller diameter tube portion 16*c* of the spacer 16. A point on the smaller diameter tube portion 16*c* of the spacer 16 to which a water resistance force is transmitted is spaced by a distance S from the propeller shaft 11 and is distant from a point of application of an average thrust on a thrust force transmission surface between the taper hole 16*a* of the spacer 16 and the taper portion 11*b* engaged with the spacer 16. Thus, a moment effect occurs on a lower portion of the taper portion 11*b* of the propeller shaft 11 rotating at a high speed due to the water resistance force F and the distance L. This situation causes a precession being a load fluctuation in which a surface of the taper hole 16*a* of the spacer 16 repeatedly separates from the taper portion 11*b* and then firmly contacts the taper portion 11*b* of the propeller shaft 11 during the high speed rotation, which results in the spacer 16 abrading the thrust transmission surface (the taper portion 11*b*). Further, the concentricity between the boss 14*a* and the bushing 14*c* is maintained by the rubber damper 14*b*, and thus when the watercraft is propelled at a high speed (when the propeller rotates at a high speed), the hull or the stern comes to the surface, a draft line lowers, an upper portion of the propeller is exposed to air, and a water resistance force F acts upward on the lower portion of the propeller 13. In such a situation, a lower portion of the rubber damper 14*b* is compressed, and as a result, the boss 14*a* moves up toward the bushing 14*c*. Therefore, the end wall 14*a*' of the boss 14*a* slides on the end surface 16*b*. The end wall 14*a*' of the boss 14*a* continuously slides on the end surface 16*b* of the spacer 16 and this sliding movement causes an abrasion on both sliding surfaces due to rotation of the propeller 13 if there is a water resistance force F acting thereupon. Due to continued abrasion between the sliding surfaces, the end wall 14*a*' of the boss 14*a* and the end surface 16*b* of the spacer 16 separate below the propeller shaft 11 and contact above the propeller shaft 11. Therefore, because the propeller 13 is rotating, the rotation accompanies repeated separating and contacting between the taper hole 16*a* and the taper part 11*b*, as described above. This results in a large intensification of the precession mentioned above and an occurrence of abrasion on the thrust transmission surface (the taper portion 11*b*) by the spacer 16.

SUMMARY OF THE INVENTION

In order to overcome the problems described above, preferred embodiments of the present invention provide a propeller thrust transmission device for a watercraft propulsion device in which a moment effect is substantially avoided even if a water resistance force acts upward on a lower portion of a propeller when an upper portion of the propeller is exposed to air as the propeller rotates, wherein an occurrence of a precession by a spacer around an entire circumference of a taper portion of a propeller shaft is prevented, and abrasion by a spacer on a thrust transmission surface is prevented.

A first aspect of a preferred embodiment of the present invention provides a taper portion provided at a position near a lower case, in which a propeller attachment device is fitted and fixed on the outer shaft portion protruding outward from the lower case, a diameter of an end of the taper portion located closer to the lower case is larger (hereinafter referred to as the larger diameter end) than a diameter of an end of the taper portion located closer to a propeller (hereinafter referred to as the smaller diameter end), and a spacer including a taper hole having an inner surface which corresponds in shape to an outer surface of the taper portion and in which the taper portion is fitted, the spacer including an end surface arranged to contact an end wall of the propeller attachment device, a smaller diameter tube portion (i.e., having a smaller diameter than an outer diameter of the other portions of the spacer) fitted in a hole in the end wall of the propeller attachment device such that a thrust force acting on the propeller when the propeller rotates in its normal direction is received by the taper portion of the propeller shaft through the spacer, a first half and a second half separate from the first half, wherein the first half includes the taper hole having an inner surface which corresponds in shape to an outer surface of the taper portion and in which the taper portion is fitted, the second half is located closer to the propeller relative to the first half and has a ring-shaped wall portion firmly contacting a side surface of the first half, a portion extending from one side of the ring-shaped wall portion closer to the propeller is the smaller diameter tube portion fitted in the hole in the end wall of the propeller attachment device and spaced from the propeller shaft, and a portion extending from the other side of the ring-shaped wall portion has a larger diameter tube portion (i.e., having a larger diameter than the smaller diameter tube portion) fitted on an outer peripheral surface positioned outside the taper hole.

A second aspect of a preferred embodiment of the present invention provides the propeller thrust transmission device for a watercraft propulsion device in accordance with the first aspect, in which a firm contacting surface between the side surface of the first half and the ring-shaped wall portion of the second half corresponds to the smaller diameter end of the taper portion of the propeller shaft.

A third aspect of a preferred embodiment of the present invention provides the propeller thrust transmission device for a watercraft propulsion device in accordance with the first or second aspect, in which the smaller diameter tube portion is force fitted in the hole in the end wall of the propeller attachment device.

A fourth aspect of a preferred embodiment of the present invention provides the propeller thrust transmission device for a watercraft propulsion device in accordance with any one of the first through third aspects, in which the propeller attachment device is furnished with a boss united with a blade portion of the propeller, a bushing mounted inside the boss in which the propeller shaft is fitted, an elastically deformable damper member provided between the boss and the bushing, and a concentricity maintaining ring provided on an end portion of the bushing closer to the lower case so as to fill a space between the bushing and the boss and so as to maintain the concentricity between the bushing and the boss (i.e., the bushing and the boss maintain a common center axis and thus do not move toward or away from each other), and is fixed to the propeller shaft by a nut.

In accordance with the first aspect of a preferred embodiment of the present invention, when a hull or stern comes to the surface and an upper portion of the propeller is exposed to air when the propeller rotates, a water resistance force acts upward on a lower portion of the propeller. This water resistance force acting upward on the lower portion of the propeller increases due to a thrust force when the watercraft is propelled at a high speed, and the force acts on the propeller shaft. A water resistance force acting upward on the lower portion of the propeller is transmitted from the attachment device of the propeller to the smaller diameter tube portion of the second half. Further, the force is transmitted from the larger diameter tube portion of the second half to the first half. At this point, if the spacer is formed into one body as in a conventional case described above, a moment occurs due to an upward force acting upward on the smaller diameter tube portion at a point of application of an average thrust on a thrust force transmission surface. However, in preferred embodiments of the present invention, the spacer is separated into the first half and the second half. A fitting between the larger diameter tube portion of the second half and the outer peripheral surface positioned outside the taper hole of the first half is not actually integrated into one unitary body. Therefore, a water resistance force acting upward on the lower portion of the propeller acts upward on the smaller diameter tube portion of the second half, and is transmitted from the larger diameter tube portion to the outer peripheral surface positioned outside the taper hole because of the space between the smaller diameter tube portion and the propeller shaft. Consequently, a water resistance force acts on a position practically corresponding to a point of application of an average thrust on a thrust force transmission surface between the taper hole of the first half and the taper portion of the propeller shaft, and thus a moment effect almost does not occur. An occurrence of a precession of a surface of the taper hole of the spacer around an entire circumference of the taper portion of the propeller shaft is prevented, and thus an abrasion on a thrust transmission surface by the spacer can be prevented. Further, a position in which an upward force acting on the propeller is transmitted to the propeller shaft is changed because the spacer is divided into the first half and the second half. Therefore, reshaping of the propeller or the lower case is not necessary, and an application to a product that has been already shipped and sold can be facilitated.

In accordance with the second aspect of a preferred embodiment of the present invention, a ring-shaped side wall of a second half can have a minimal thickness and still maintain the necessary strength. This allows the inner surface of the taper hole of the first half to correspond to an outer surface of the taper portion of the propeller shaft over an entire length of the taper portion, and thereby an occurrence of a moment effect is inhibited. A thrust force per unit area becomes smaller because an area receiving a thrust force becomes larger than a conventional case, and a force acting upward on the propeller per unit area becomes smaller also. Therefore, it can more effectively prevent an occurrence of a precession of the surface of the taper hole of the spacer around the entire circumference of the taper portion.

In accordance with the third aspect of a preferred embodiment of the present invention, assembly of the first half, the second half, and the propeller into a securely fixed state is facilitated. An occurrence of a precession can be prevented on a fitting surface between the first half and the second half, and a fitting surface between the second half and the attachment device of the propeller, and thereby abrasion can be prevented.

In accordance with the fourth aspect of a preferred embodiment of the present invention, the boss and the bushing maintain their concentricity about a direction of the propeller shaft. The concentricity is maintained generally by the elastically deformable damper member provided between the boss and the bushing, and by the concentricity maintaining ring at a location closer to the lower case. When the watercraft is propelled at a high speed (when the propeller rotates at a high speed), a hull or a stern comes to the surface, a draft line lowers, and an upper portion of the propeller is exposed to air. A water resistance force acts upward on a lower portion of the propeller, and compresses a lower portion of the rubber damper. Therefore, a state in which the bushing moves up toward the boss is prevented at a location closer to the lower case if the bushing itself moves up toward the boss. As a result, a sliding movement of the end wall of the boss on the end surface of the spacer is prevented, and thus abrasion on the end wall of the boss and the end surface is prevented. Therefore, an occurrence of abrasion on the thrust transmission surface (the taper portion) by the spacer is prevented.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described hereinafter.

Figure 1:
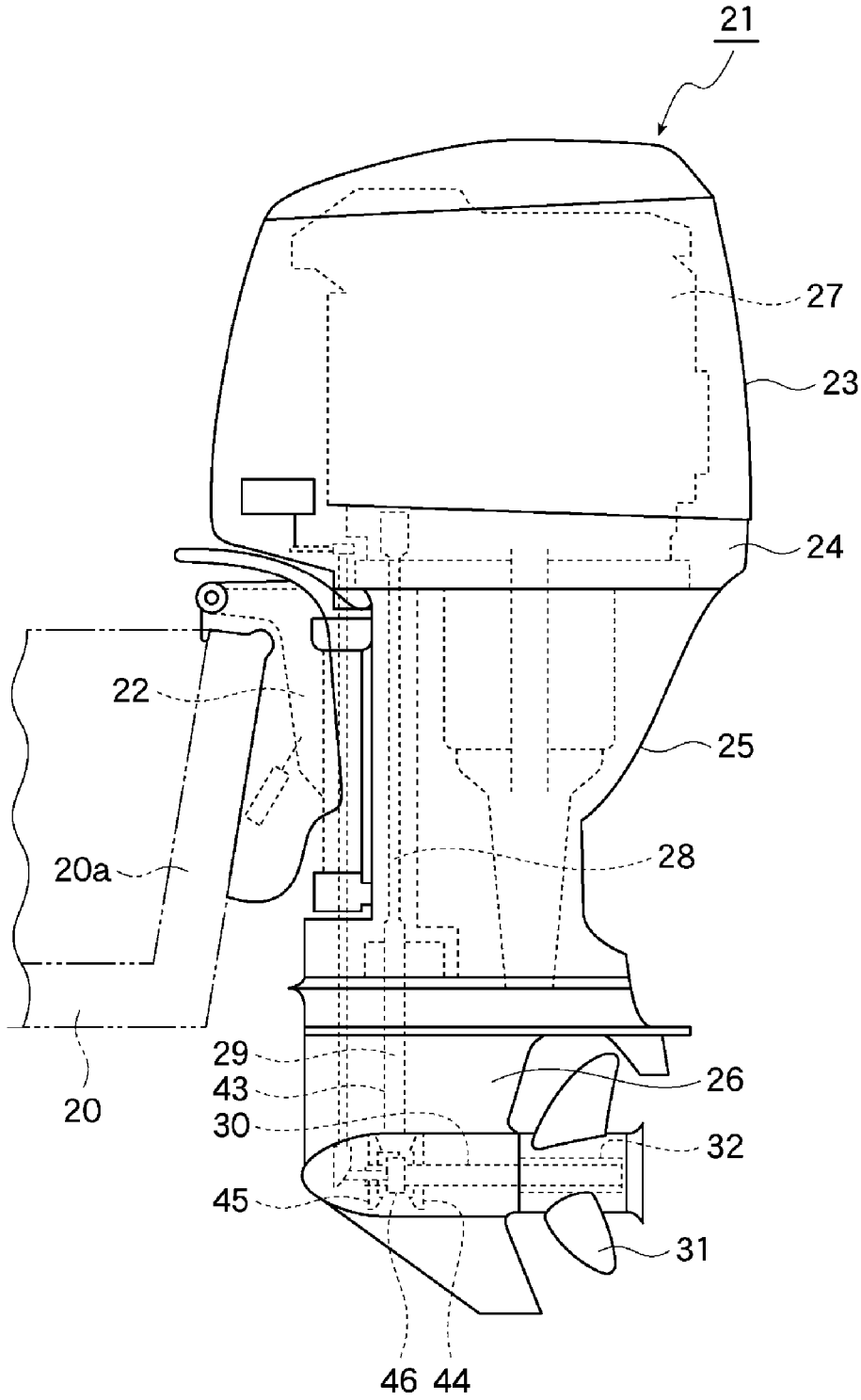
FIG. 1 is a side view of a watercraft propulsion device according to a first preferred embodiment of the present invention.

As shown in FIG. 1, an outboard motor 21 as the "watercraft propulsion device" is mounted on a transom board 20*a* at a stern of a hull 20 by a swivel bracket 22 such that the outboard motor 21 can be tilted up. A propeller thrust transmission device according to a preferred embodiment of the present invention is provided for a propeller shaft 30 and a propeller 31 of the outboard motor 21.

First, a general construction of the outboard motor 21 will be described. As shown in FIG. 1, the outboard motor 21 has a top cowling 23, a bottom cowling 24, an upper case 25, and a lower case (gear case) 26. An engine 27 is disposed inside the top cowling 23 and the bottom cowling 24. The propeller 31 is driven by a rotation output of the engine 27 by a drive shaft 28 disposed vertically inside the upper case 25, a gear shaft 29 disposed vertically, and the propeller shaft 30 disposed horizontally in the lower case 26.

The upper end of the drive shaft 28 is connected with a crankshaft of the engine 27 such that they are rotatable together. A lower end of the drive shaft 28 is connected with the gear shaft 29 such that they are rotatable together. A bevel gear 43 fixed at the lower end of the gear shaft 29 is in meshing engagement with bevel gears 44 and 45 rotatably supported by the lower case 26. Rotation of the drive shaft 28 is transmitted to the gear shaft 29 with a reduced rotational speed, and a rotational direction of the propeller shaft 30 is changed by actuation of a dog clutch 46 in the transmission.

The dog clutch 46 is provided at a location close to the front end of the propeller shaft 30 to be movable axially therealong. When the dog clutch is in a neutral position, a protrusion of the clutch is released from engagement with either bevel gear 44 or 45, and rotation of the propeller shaft 30 stops.

When the dog clutch 46 moves closer to the propeller 31, the protrusion of the clutch engages with the bevel gear 44, and the propeller shaft rotates in a direction to drive the watercraft forward. When the dog clutch 46 moves closer to the hull, the protrusion of the clutch engages with the bevel gear 35, and the propeller shaft 30 rotates in a direction to drive the watercraft rearward.

Figure 2:
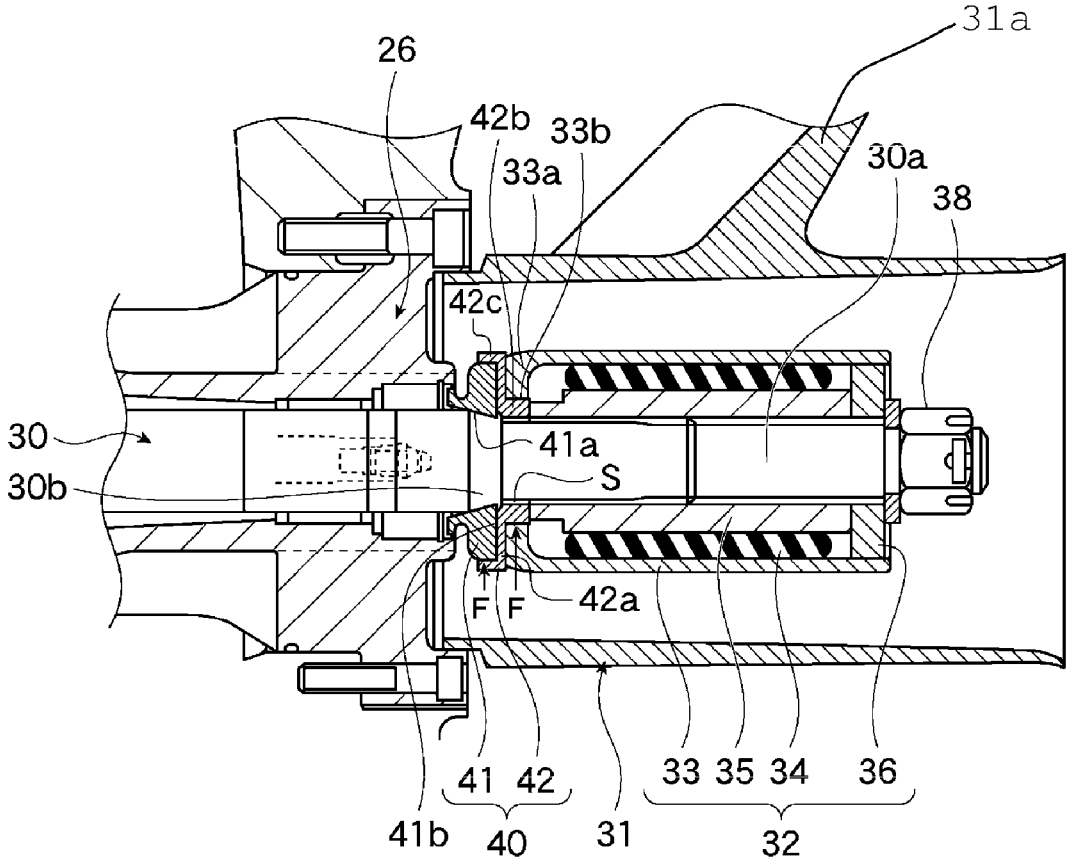
FIG. 2 is a cross sectional view of a propeller thrust transmission device for a watercraft propulsion device according to the first preferred embodiment of the present invention.

As shown in FIG. 2, the propeller shaft 30 is almost horizontally disposed and rotatably supported in the lower case 26. An attachment device 32 of the propeller 31 is fixed at a location close to the rear end of the propeller shaft 30. The attachment device 32 is structured with a boss 33 united with the propeller 31, a tubular rubber damper 34 as a damper member press-fitted in the boss 33, a bushing 35 press-fitted inside the rubber damper 34, and an endplate 36 loosely fitted to the propeller shaft 30 and fitted in the boss 33 with a loose fit tolerance. The bushing 35 is spline-fitted on an outer shaft portion 30*a* protruding outward from the lower case 26 while the boss 33, the rubber damper 34, and the bushing 35 are combined together. The endplate 36 is fitted in the boss 33 and fixed thereto by a nut 38. Although the rubber damper 34 in this preferred embodiment is preferably made of rubber, the damper member can be formed from an elastic member other than rubber that can be formed into a tubular shape and elastically deform between the boss 33 and the bushing 35.

The propeller thrust transmission device is provided in the watercraft propulsion device with the above construction as described hereinafter.

In the propeller thrust transmission device for a watercraft propulsion device, as mentioned above, the attachment device 32 of the propeller 31 is spline-fitted on the outer shaft portion 30*a* protruding outward from the lower case 26, and fixed thereto by a nut 38. The propeller thrust transmission device includes a taper portion 30*b* in a position near the lower case of the outer shaft portion 30*a*, in which a diameter of an end closer to the lower case is larger (hereinafter referred to as the larger diameter end) than a diameter of an end closer to the propeller (hereinafter referred to as the smaller diameter end), and a spacer 40 having an inner surface which corresponds in shape to an outer surface of the taper portion 30*b* and in which the taper portion 30*b* is fitted. A thrust force acting on the propeller 31 when the propeller 31 rotates in its normal direction is received by the taper portion 30*b* of the propeller shaft 30 through the spacer 40.

The spacer 40 preferably includes a first half 41 and a second half 42. The first half 41 includes a taper hole 41*a* having an inner surface which corresponds in shape to an outer surface of the taper portion 30*b* of the propeller shaft 30 and in which the taper portion 30*b* is fitted. The second half 42 is provided at a location closer to the propeller relative to the first half 41 and has a ring-shaped wall portion 42*a* firmly contacting a side surface 41*b* of the first half 41. A portion extending from one side of the ring-shaped wall portion 42*a* closer to the propeller has a smaller diameter tube portion 42*b* (i.e., having a smaller diameter than an outer diameter of the other portions of the second half 42 of the spacer 40) arranged to be fitted in a hole 33*b* in the end wall 33*a* of the boss 33 of the propeller 31 and spaced by a distance S from the propeller shaft 30. A portion extending from the other side of the ring-shaped wall portion 42*a* has a larger diameter tube portion 42*c* (i.e., having a larger diameter than an outer diameter of the smaller diameter tube portion 42*b*) arranged to be fitted to an outer peripheral surface 41*c* positioned outside the taper hole 41*a* of the first half 41.

The propeller shaft 30 and the propeller 31 are preferably made of stainless steel. It is preferable that the first half 41 and the second half 42 are made of brass and plated with hard chromium.

Next, an effect of this preferred embodiment will be described with reference to FIG. 2.

In the case that the hull or the stern comes to the surface, a draft line lowers, and an upper portion of the propeller 31 is exposed to air when the propeller is rotating, a water resistance force acts upward on a lower portion of the propeller 31. The water resistance force acting upward on the lower portion of the propeller 31 becomes the largest together with a thrust force when the watercraft is driven at a high speed, and acts on the propeller shaft 30.

In the above construction, a side surface of an end wall 33*a* of the boss 33 of the propeller 31 firmly contacts a side surface of the ring-shaped wall portion 42*a* of the second half 42. A side surface on the opposite side of the ring-shaped wall portion 42*a* of the second half 42 firmly contacts a side surface of the side surface portion 41*b* of the first half 41. The inner surface of the taper hole 41*a* of the first half 41 and an outer surface of the taper portion 30*b* of the propeller shaft 30 correspond to each other. Therefore, a thrust force acting on the propeller 31 is transmitted from the side surface of the end wall 33*a* of the boss 33 of the propeller 31 to the side surface of the ring-shaped wall portion 42*a* of the second half 42. Then, the thrust force is transmitted from the side surface on the opposite side of the ring-shaped wall portion 42*a* of the second half 42 to the side surface of the side surface portion 41*b* of the first half 41, and next transmitted from the taper hole 41*a* of the first half 41 to the taper portion 30*b* of the propeller shaft 30.

Figure 4:
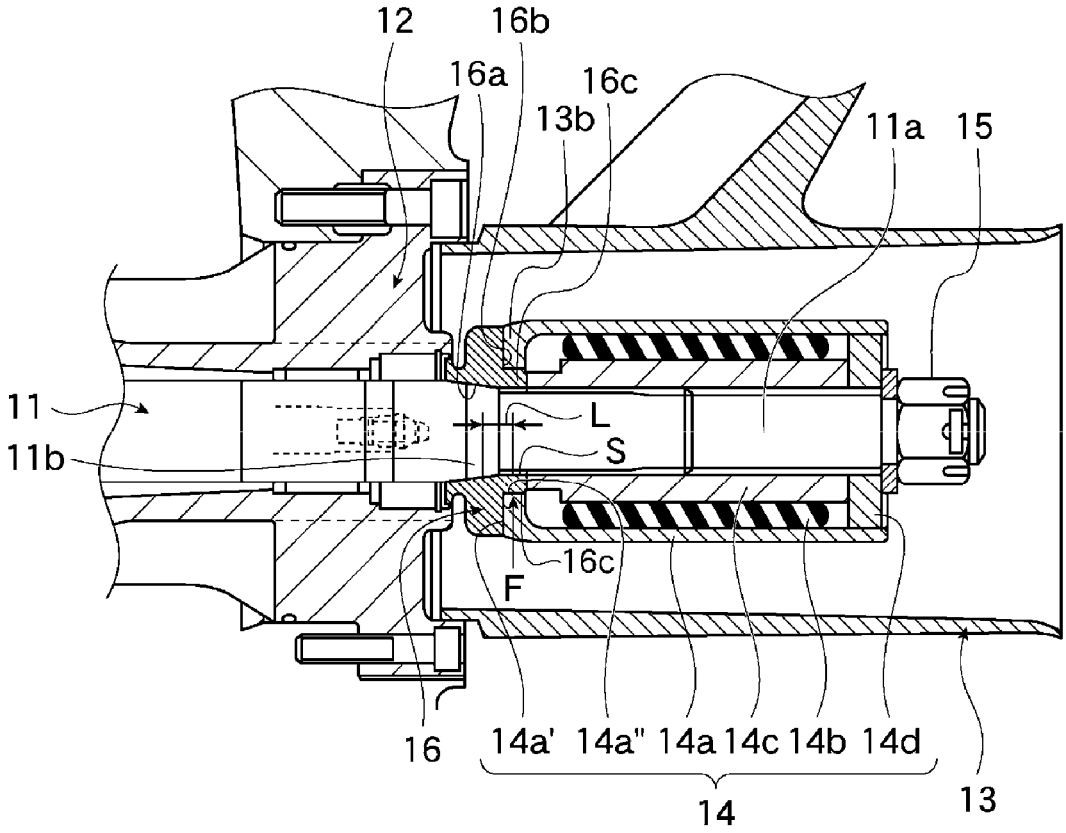
FIG. 4 PRIOR ART
FIG. 4 is across sectional view of a conventional propeller thrust transmission device for a watercraft propulsion device.

In the above construction, if the spacer 40 is formed into one body as in a conventional case shown in FIG. 4, a moment acts on a point of application of an average thrust on a thrust force transmission surface due to an upward force acting upward on the smaller diameter tube portion 42*b*. However, in this preferred embodiment, the spacer 40 is divided into the first half 41 and the second half 42. The larger diameter tube portion 42*c* of the second half 42 is fitted to the outer peripheral surface positioned outside the taper hole 41*a* of the first half 41, and there is the space S between the smaller diameter tube portion 42*b* and the outer shaft portion 30*a* of the propeller shaft 30. Therefore, a water resistance force F acting upward on the lower portion of the propeller 31 acts upward on the smaller diameter tube portion 42*b* of the second portion 42, and is transmitted from the larger diameter tube portion 42*c* to the outer peripheral surface positioned outside the taper hole 41*a* of the first half 41. This force is then transmitted from the taper hole 41 of the first half 41 to the taper portion 30*b* of the propeller shaft 30. Thereby, a water resistance force F acting upward on the lower portion of the propeller 31 mentioned above acts on a position almost corresponding to a point of application of an average thrust on a thrust force transmission surface between the taper hole 41*a* of the first half 41 and the taper portion 30*b* of the propeller shaft 30.

With the propeller thrust transmission device of this preferred embodiment, a point of application of a water resistance force acting upward on the lower portion of the propeller 31 almost corresponds to a point of application of an average thrust on the thrust force transmission surface between the taper hole 41*a* of the first half 41 and the taper portion 30*b* of the propeller shaft 30, and thus a moment effect due to a water resistance force acting upward on the lower portion of the propeller 31 almost does not occur. Therefore, the occurrence of a precession of the surface of the taper hole 41*a* of the first half 41 around an entire circumference of the taper portion 30*b* of the propeller shaft 30 is prevented, and abrasion on the thrust transmission surface by the first half 41 of the spacer 40 can be prevented. Further, the spacer 40 is divided into the first half 41 and the second half 42, and thus a position in which an upward force acting on the propeller 31 is transmitted to the propeller shaft 30 is changed. Therefore, reshaping of the propeller 31 or the lower case 26 is not necessary, and an application to a product that has already been shipped and sold can be facilitated.

In this preferred embodiment, the firm contacting surface between the side surface of the first half 41 and the ring-shaped wall portion of the second half 42 corresponds to the smaller diameter end of the taper portion 30*b* of the propeller shaft 30. With this construction, a ring-shaped side wall 42*a* of a second half 42 can have a minimal thickness while still maintaining the necessary strength. This allows an inner surface of the taper hole 41*a* of the first half 41 to correspond to an outer surface of the taper portion 30*b* of the propeller shaft 30 over an entire length of the taper portion 30*b*, and thereby, the occurrence of a moment effect is inhibited. A thrust force per unit area becomes smaller because an area receiving a thrust force becomes larger than a conventional case, and a force acting upward on the propeller 31 per unit area becomes smaller also. Therefore, it can more effectively prevent an occurrence of a precession of the surface of the taper hole 41*a* of the first half 41 around the entire circumference of the taper portion 30*b* of the propeller shaft 30.

In this preferred embodiment, the small diameter tube portion 42*b* is force fitted in a hole 33*b* in the end wall 33*a* of the attachment device 33 of the propeller 31. Consequently, the second half 42, which defines a portion of the spacer 40, is substantially engaged with the boss 33 of the propeller 31 because of the length of the smaller diameter portion 42*b* force fitted in an axial direction. Therefore, a water resistance force F acting upward on the lower portion of the propeller 31 is certainly transmitted from the larger diameter tube portion 42*c* of the second half 42 to the outer peripheral surface positioned outside the taper hole 41*a* of the first half 41, and acts on a position almost corresponding to a point of application of an average thrust on the thrust force transmission surface between the taper hole 41*a* of the first half 41 and the taper portion 30*b* of the propeller shaft 30. The larger diameter tube portion 42*c* is fitted on the outer peripheral surface positioned outside the taper hole 41*a* of the first half 41 to have a loose fit tolerance, and thus, it prevents an occurrence of a precession on a fitting surface.

Figure 3:
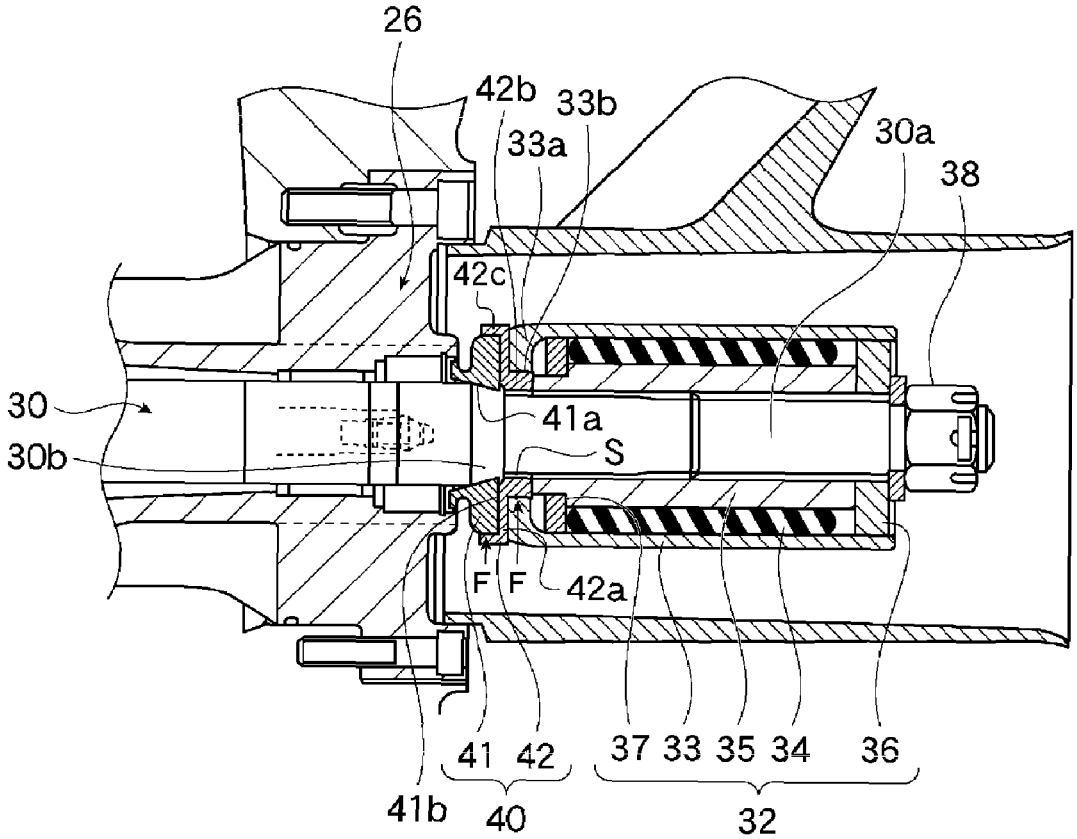
FIG. 3 is a cross sectional view of a propeller thrust transmission device for a watercraft propulsion device according to a second preferred embodiment of the present invention.

FIG. 3 is a cross-sectional view of the propeller thrust transmission device for a watercraft propulsion device according to a second preferred embodiment of the present invention. The propeller thrust transmission device includes a concentricity maintaining ring 37 at an end portion of the bushing 35 closer to the lower case 26, and thereby the concentricity between the boss 33 and the bushing 35 is maintained at the end of the bushing 35 closer to the lower case 26 if the rubber damper 34 between the boss 33 and the bushing 35 elastically deforms and flexes. Other elements are preferably the same as the first preferred embodiment.

More specifically, in this propeller thrust transmission device, the attachment device 32 of the propeller 31 is provided with the boss 33 united with the blade portion 31*a* of the propeller 31 and having an exhaust passage for combustion gas of the engine, the bushing 35 positioned in the boss 33 and is spline-fitted to the propeller shaft 30, the rubber damper 34 press-fitted in a tube-shaped space between the boss 33 and the bushing 35, and the endplate 36 for closing the bushing 35 and the rubber damper 34 therein. In addition, the attachment device 32 is furnished with the concentricity maintaining ring 37 for maintaining the concentricity between the bushing 35 and the boss 33, which is force fitted in an end of the bushing 35 closer to the lower case and fills a space between the bushing 35 and the boss 33 with a loose fit tolerance to the boss 33. The attachment device 32 is clamped down and fixed to a screw portion at an end of the propeller shaft 30 by a nut 38.

With this construction, although the concentricity between the boss 33 and the bushing 35 as a whole is maintained by the rubber damper 34, the concentricity is maintained with the concentricity maintaining ring 37 at a location closer to the lower case if the rubber damper 34 flexes. That is, in the case that the hull or the stern comes to the surface, a draft line lowers, and the upper portion of the propeller is exposed to air when the watercraft is propelled at a high speed (when the propeller rotates at a high speed), a water resistance force F acts upward on the lower portion of the propeller. In this situation, a lower portion of the rubber damper 34 is compressed. It causes a state in which the boss 33 moves up toward the bushing 35. However, the state in which the boss moves up toward the bushing is prevented at the location closer to the lower case. As a result, a sliding movement of the end wall of the boss 33 on the end surface of the spacer is prevented, and thereby an occurrence of abrasion between the end wall 33*a* of the boss 33 and the end surface of the second half 42 is prevented, and further, an occurrence of abrasion between the second half 42 and the end surface of the first half 41 is prevented. Therefore, an occurrence of abrasion on the thrust transmission surface (the taper portion) of the propeller shaft 30 by the first half 41 is prevented.

In each of the above preferred embodiments, the outboard motor 21 is preferably used as the "watercraft propulsion device." However, the present invention is not limited to this, and the outboard motor 21 may be replaced by an inboard/outboard motor. It is only required that the fitting between the hole 33*b* of the boss 33 of the propeller 31 and the smaller diameter tube portion 42*b* of the second half 42, and the fitting between the larger diameter tube portion 42*c* of the second half 42 and the outer periphery portion of the first half 41 provide a steady bond between a shaft and a hole without wobbling. The concentricity maintaining ring 37 should be force fitted in either one of the boss or the bushing and fitted in the other with a loose fit tolerance.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A propeller thrust transmission device for a watercraft propulsion device, the propeller thrust transmission device comprising:

a propeller shaft including a taper portion having a larger diameter end and a smaller diameter end, the larger diameter end having a larger diameter than that of the smaller diameter end;

a spacer including a taper hole having an inner surface corresponding in shape to an external surface of the taper portion; and a propeller attachment device arranged to be engaged with the propeller shaft through the spacer; wherein the spacer includes:

a first half including the taper hole arranged to engage the taper portion of the propeller shaft; and a second half separate from the first half, the second half including a forward end surface arranged to engage the first half of the spacer, a larger diameter portion extending from the forward end surface and arranged to engage an outer peripheral surface of the first half of the spacer, a rearward end surface arranged to contact an end wall of the propeller attachment device, and a smaller diameter portion extending from the rearward end surface and arranged to fit into a hole in the end wall of the propeller attachment device, the larger diameter portion of the second half having a larger diameter than that of the smaller diameter portion of the second half;

the propeller attachment device includes:

a boss integral with a blade portion of a propeller;

a bushing mounted inside the boss, the propeller shaft fitted inside the bushing;

an elastically deformable damper member provided between the boss and the bushing; and a concentricity maintaining ring provided on a forward portion of the bushing and extending between the bushing and the boss so as to maintain the concentricity between the bushing and the boss; and the forward end surface of the second half of the spacer arranged to engage the first half of the spacer is substantially aligned with the smaller diameter end of the taper portion in a vertical direction.

2. The propeller thrust transmission device for a watercraft propulsion device according to claim 1, wherein the smaller diameter portion is force fit in the hole in the end wall of the propeller attachment device.

3. A propeller thrust transmission device for a watercraft propulsion device, the propeller thrust transmission device comprising:

a propeller shaft including a taper portion having a larger diameter end and a smaller diameter end, the larger diameter end having a larger diameter than that of the smaller diameter end;

a spacer including a taper hole having an inner surface corresponding in shape to an external surface of the taper portion; and a propeller attachment device arranged to be engaged with the propeller shaft through the spacer; wherein the spacer includes:

a first half including the taper hole arranged to engage the taper portion of the propeller shaft; and a second half separate from the first half, the second half including a forward end surface arranged to engage the first half of the spacer, a larger diameter portion extending from the forward end surface and arranged to engage an outer peripheral surface of the first half of the spacer, a rearward end surface arranged to contact an end wall of the propeller attachment device, and a smaller diameter portion extending from the rearward end surface and arranged to fit into a hole in the end wall of the propeller attachment device, the larger diameter portion of the second half having a larger diameter than that of the smaller diameter portion of the second half; wherein the forward end surface of the second half of the spacer arranged to engage the first half of the spacer is substantially aligned with the smaller diameter end of the taper portion in a vertical direction.

4. The propeller thrust transmission device for a watercraft propulsion device according to claim 3, wherein the smaller diameter portion is force fit in the hole in the end wall of the propeller attachment device.

5. A propeller thrust transmission device for a watercraft propulsion device, the propeller thrust transmission device comprising:

a propeller shaft including a taper portion having a larger diameter end and a smaller diameter end, the larger diameter end having a larger diameter than that of the smaller diameter end;

a spacer including a taper hole having an inner surface corresponding in shape to an external surface of the taper portion; and a propeller attachment device arranged to be engaged with the propeller shaft through the spacer; wherein the spacer includes:

a first half including the taper hole arranged to engage the taper portion of the propeller shaft; and a second half separate from the first half, the second half including a forward end surface arranged to engage the first half of the spacer, a larger diameter portion extending from the forward end surface and arranged to engage an outer peripheral surface of the first half of the spacer, a rearward end surface arranged to contact an end wall of the propeller attachment device, and a smaller diameter portion extending from the rearward end surface and arranged to fit into a hole in the end wall of the propeller attachment device, the larger diameter portion of the second half having a larger diameter than that of the smaller diameter portion of the second half; and the propeller attachment device includes:

a boss integral with a blade portion of a propeller;

a bushing mounted inside the boss, the propeller shaft fitted inside the bushing;

an elastically deformable damper member provided between the boss and the bushing; and a concentricity maintaining ring provided on a forward portion of the bushing and extending between the bushing and the boss and so as to maintain the concentricity between the bushing and the boss.

* * * * *